US006045283A

United States Patent [19]

Velasquez et al.

[11] Patent Number: 6,045,283

[45] Date of Patent: Apr. 4, 2000

[54] NOZZLE ASSEMBLY

[76] Inventors: Joseph Pepe Velasquez, 102 E. 15th St., Tempe, Ariz. 85281; Peter J. Shigo, 2498 E. Kent Ave., Gilbert, Ariz. 85297

[21] Appl. No.: 09/163,134

[22] Filed: Sep. 29, 1998

[51] Int. Cl.[7] ..... B05C 17/00

[52] U.S. Cl. ..... 401/208; 401/186; 401/277; 401/219; 401/138; 401/192; 401/180

[58] Field of Search ..... 401/208, 219, 401/220, 287, 205, 207, 279, 278, 280, 138, 192, 200, 150, 143, 139, 21, 23, 25, 194

[56] References Cited

U.S. PATENT DOCUMENTS

| | | | |
|---|---|---|---|
| 1,966,143 | 7/1934 | Schroeder . | |
| 2,022,777 | 12/1935 | Mackenzie | 401/219 |
| 3,037,235 | 6/1962 | Goggans | 401/219 |
| 3,076,995 | 2/1963 | Rabelow . | |
| 3,441,355 | 4/1969 | Brown | 401/219 |
| 5,302,043 | 4/1994 | Velliquette | 401/208 |
| 5,857,796 | 1/1999 | Waldmann | 401/277 |
| 5,893,673 | 4/1999 | Edwards | 401/186 |
| 5,934,816 | 8/1999 | Bruttomesso | 401/219 |

FOREIGN PATENT DOCUMENTS

| | | | |
|---|---|---|---|
| 40953 | 7/1916 | Sweden | 401/180 |

*Primary Examiner*—Henry J. Recla
*Assistant Examiner*—Khoa D. Huynh
*Attorney, Agent, or Firm*—Parsons & Goltry; Robert A. Parsons; Michael W. Goltry

[57] ABSTRACT

A nozzle assembly for receiving and distributing a viscous mass, the nozzle assembly comprising a nozzle body including a passageway having a proximal opening for receiving viscous mass, a distal opening for expelling viscous mass and an open channel for receiving viscous mass from the distal opening, and an applicator mounted for receiving viscous mass from the open channel and for applying viscous mass to a surface.

28 Claims, 4 Drawing Sheets

FIG. 1
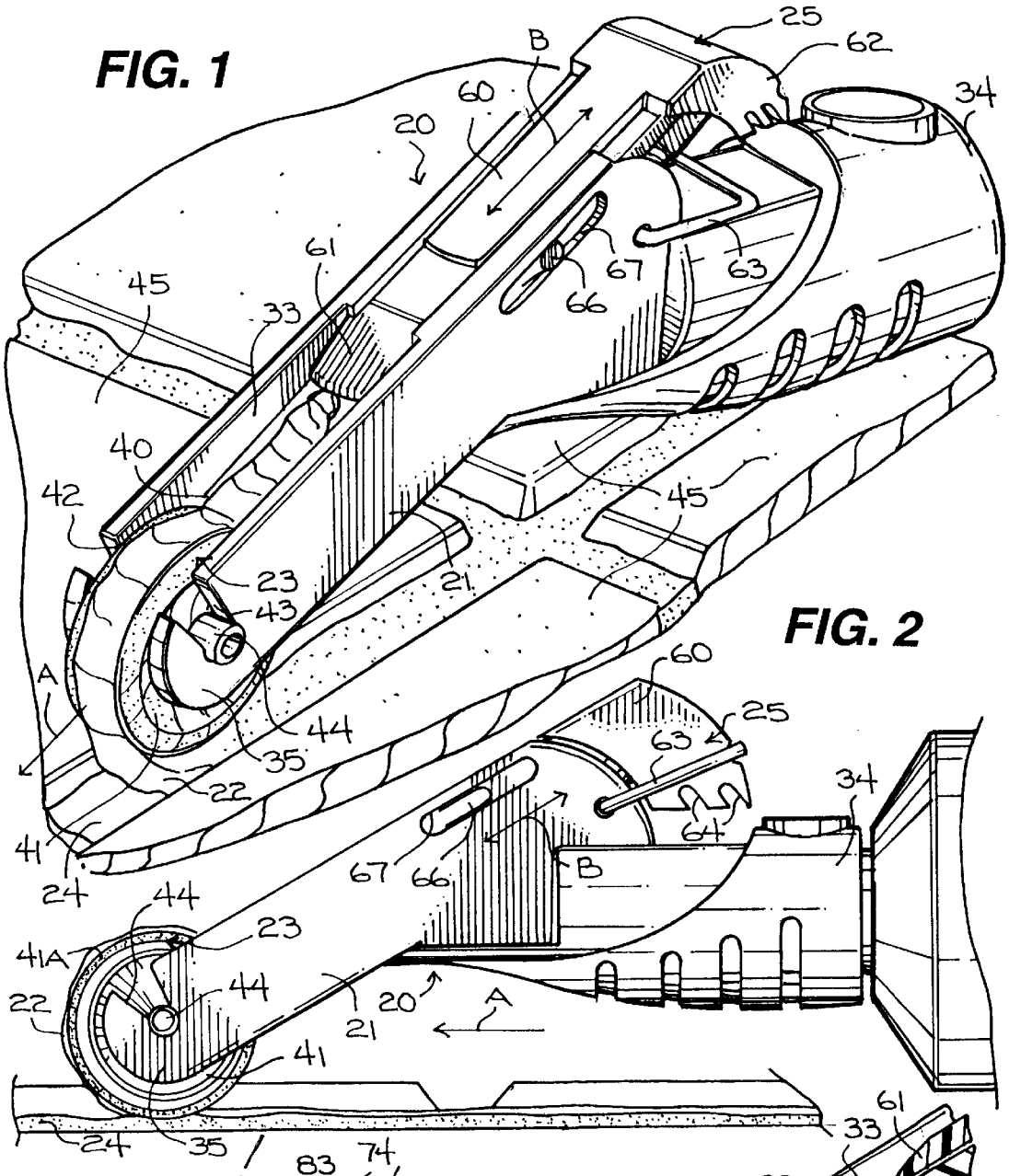
FIG. 2
FIG. 3
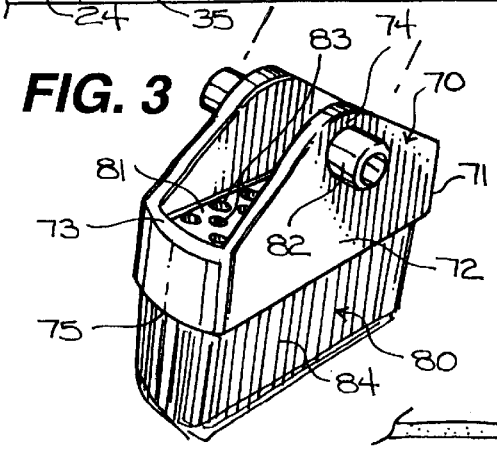
FIG. 4
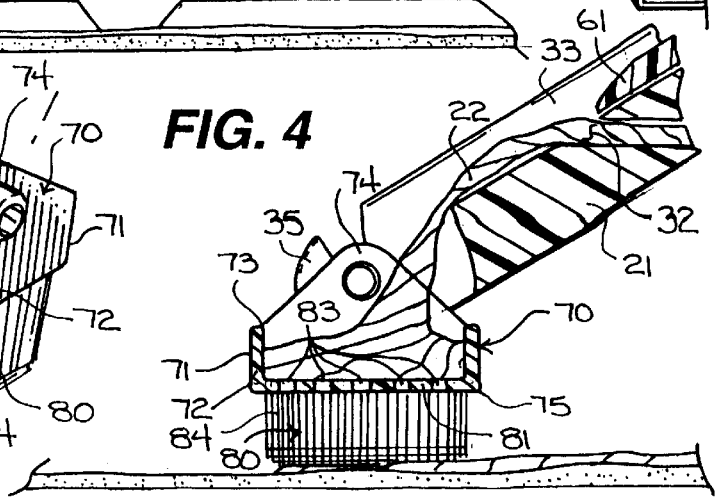

FIG. 5
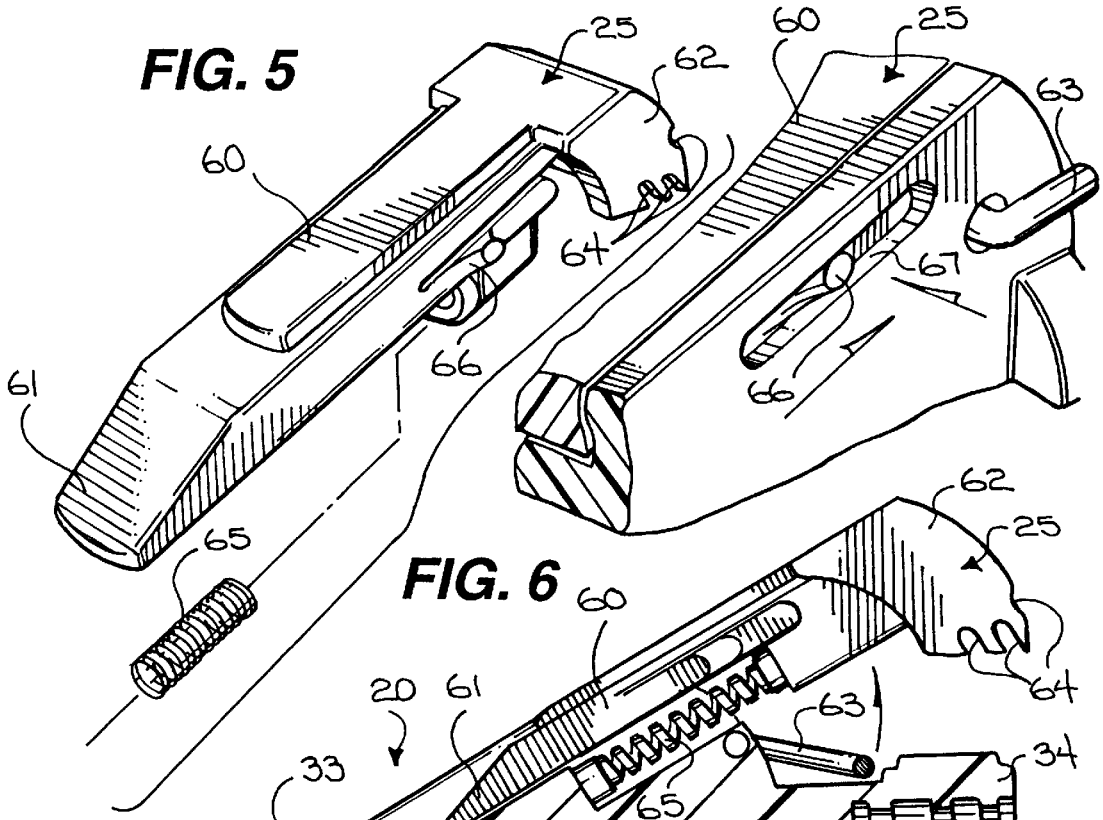
FIG. 6
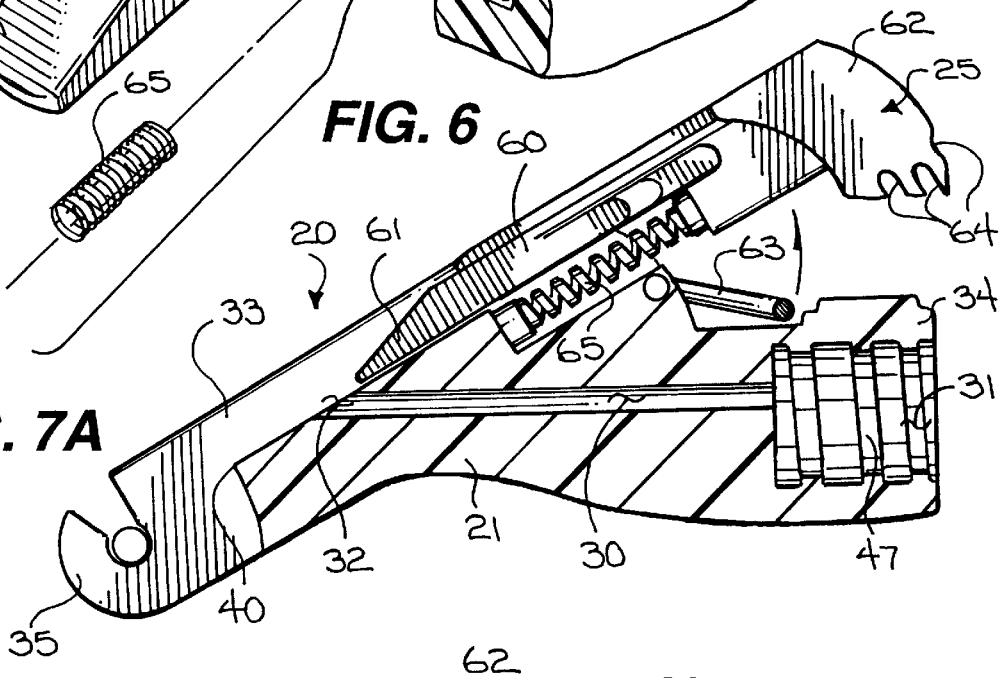
FIG. 7A
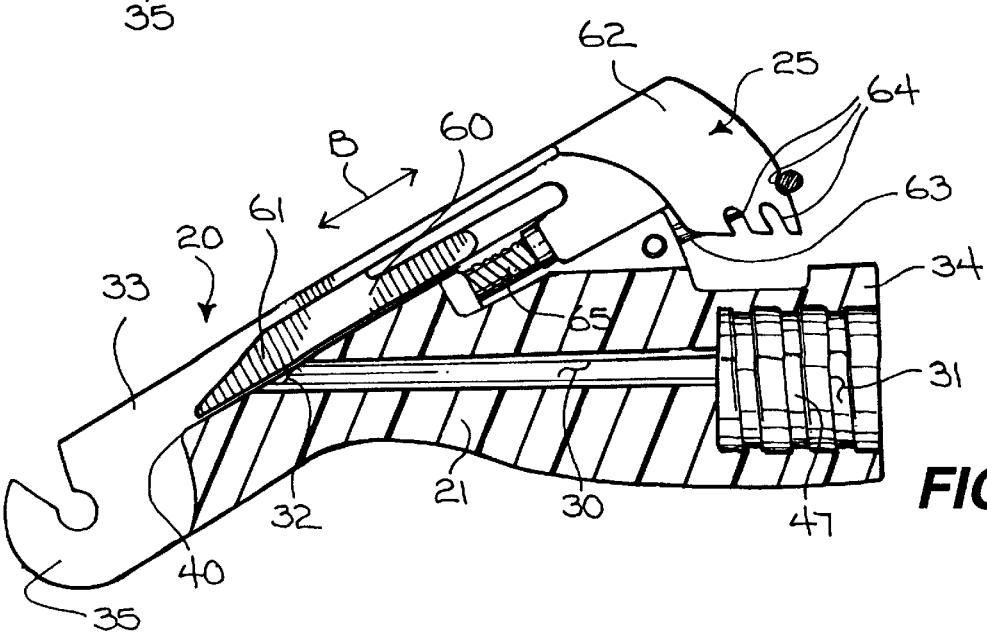
FIG. 7B

FIG. 12
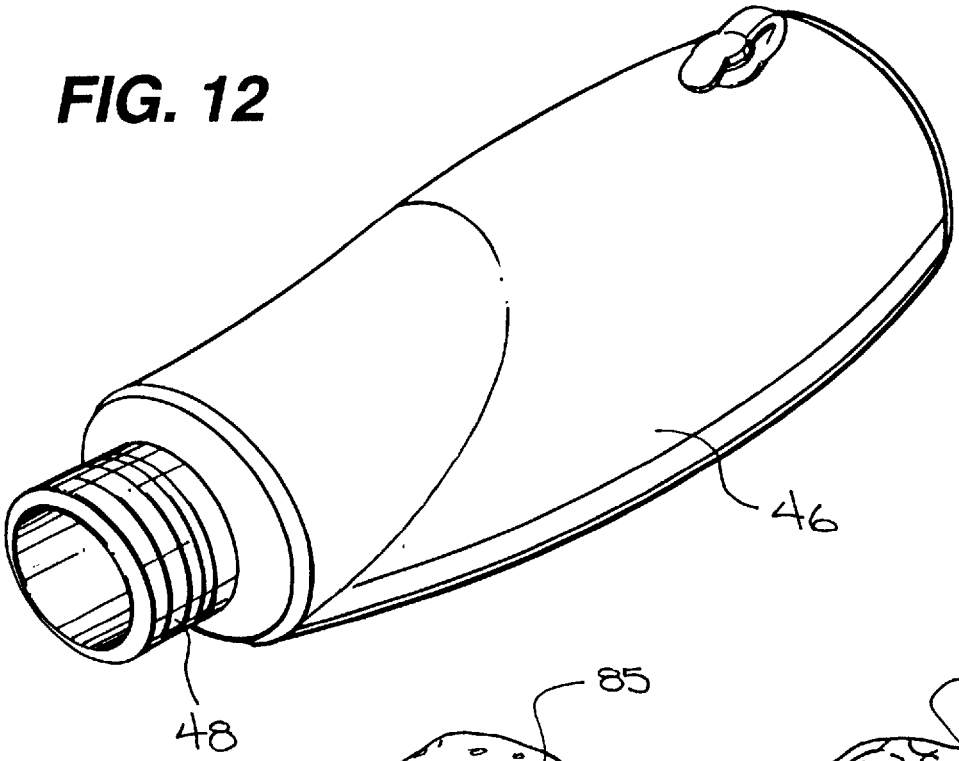
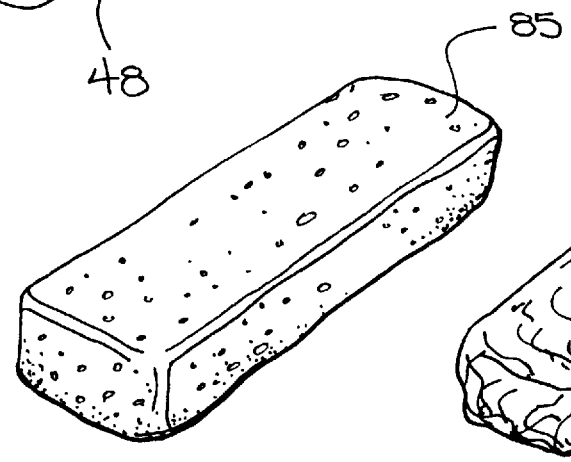
FIG. 13
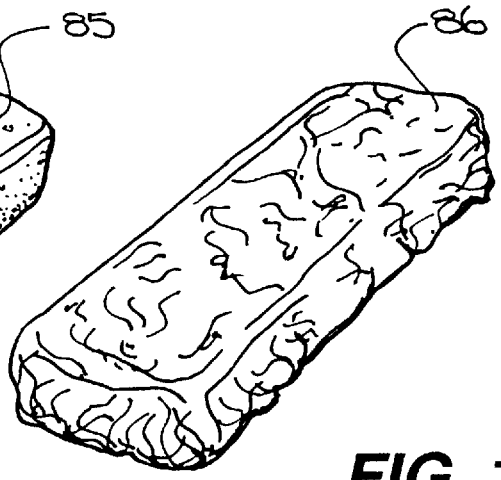
FIG. 14

NOZZLE ASSEMBLY

FIELD OF THE INVENTION

This invention relates generally to the field of nozzle assemblies and, more particularly, to nozzle assemblies for receiving, expelling and distributing viscous mass.

BACKGROUND OF THE INVENTION

Treating surfaces with cleaning solutions, protective coating solutions and other viscous mass solutions normally involves the expulsion of a selected viscous mass followed by mechanical distribution with, for instance, a rag, brush or sponge. To increase the ease and efficiency of mechanical distribution, mechanical cleaning implements have enjoyed, and continue to enjoy, considerable innovation by skilled artisans. Existing technological advances in mechanical cleaning implements, however, continue to suffer from structural and functional shortcomings in certain applications thus necessitating certain new and useful improvements.

Accordingly, it would be highly desirable to provide improved nozzle assemblies and improved mechanical applicators.

It is a purpose of the present invention to provide new and improved nozzle assemblies that are easy to construct.

It is another purpose of the present invention to provide new and improved nozzle assemblies that are easy to use.

It is still another purpose of the present invention to provide new and improved nozzle assemblies that are inexpensive.

It is a further purpose of the present invention to provide new and improved nozzle assemblies uniquely adapted for applying and mechanically distributing viscous mass to grout areas between tiles.

It is still a further purpose of the present invention to provide new and improved applicators that are easy to construct and inexpensive.

It is yet still a further purpose of the present invention to provide new and improved applicators uniquely adapted for mechanically distributing viscous mass to grout areas between tiles.

It is another purpose of the present invention to provide new and improved nozzle assemblies having removable applicators uniquely adapted for mechanically distributing viscous mass to grout areas.

It is still another purpose of the present invention to increase the ease and efficiency of applying and distributing surface treatment solutions.

It is yet still another purpose of the present invention to increase the ease and efficiency of applying and distributing surface treatment solutions to grout areas between tiles.

SUMMARY OF THE INVENTION

The above problems and others are at least partially solved and the above purposes and others are realized in new and improved nozzle assemblies and mechanical applicators for viscous mass surface application and distribution. In a particular embodiment, a nozzle assembly of the present invention generally comprises a nozzle body including a passageway having a proximal opening for receiving viscous mass, a distal opening for expelling viscous mass, and an open channel for receiving viscous mass from the distal opening. Further included is an applicator mounted for receiving viscous mass from the open channel and for applying viscous mass to a surface.

In a specific embodiment, the applicator may comprise a wheel removably mounted with the nozzle body for rotation. In another embodiment, the applicator may comprise a cradle for receiving and containing viscous mass from the open channel, an applicator body, and a foraminous body for distributing viscous mass from the cradle to the applicator body. The cradle may be carried by the nozzle body for movement in pivotal directions, and may further be removably carried by the nozzle body. The applicator, which may comprise bristles, a sponge-like pad or body, etc., is normally carried by the foraminous body, and the foraminous body is normally carried by the cradle and generally defines the floor of the cradle. The foraminous body is substantially rigid and carries foramina for communicating viscous mass from the cradle to the applicator body. The foramina are preferably substantially evenly distributed along foraminous body for substantially evenly distributing viscous mass to the applicator body.

As a means for controlling the quantity of viscous mass to the applicator, the present invention may further include a sled carried by the nozzle body for movement in reciprocal directions between a first position for occluding the distal opening and a second position for revealing the distal opening. In another embodiment, the means for controlling the quantity of viscous mass to the applicator may comprise a knob carried by the nozzle body for rotation, the knob including a way having a first diameter and a second diameter, and a lever mounted with the nozzle body for movement in pivotal directions between a first position against the way for occluding the distal opening and a second position against the way for revealing the distal opening, the first position corresponding with one of the first and second diameters and the second position corresponding to the other one of the first and second diameters.

BRIEF DESCRIPTION OF THE DRAWINGS

The foregoing and further and more specific objects and advantages of the instant invention will become readily apparent to those skilled in the art from the following detailed description thereof taken in conjunction with the drawings in which:

FIG. 1 is a perspective view of a nozzle assembly comprising a nozzle body for receiving and presenting viscous mass to an applicator for distribution to a surface and an assembly for controlling the quantity of viscous mass to the applicator, the nozzle assembly shown as it would appear in use;

FIG. 2 is a side elevational view of the nozzle assembly of FIG. 1;

FIG. 3 is a perspective view of an alternate embodiment of an applicator comprising a cradle and an applicator body;

FIG. 4 is a vertical sectional view of the applicator of FIG. 3 shown as it would appear carried by the nozzle body of FIG. 1;

FIG. 5 is a partially exploded perspective view of the assembly of FIG. 1;

FIG. 6 is a fragmented perspective view of the assembly of FIG. 5 shown as it would appear carried by the nozzle body of FIG. 1;

FIG. 7A is a vertical sectional view of the nozzle assembly of FIG. 1 shown as it would appear in open;

FIG. 7B is a vertical sectional view of the nozzle assembly of FIG. 1 shown as it would appear closed;

FIG. 12 is a perspective view of a receptacle;

FIG. 13 is a perspective view of a substantially sponge-like applicator body; and FIG. 14 is a perspective view of a substantially abrasive applicator body or scouring pad.

DETAILED DESCRIPTION OF A PREFERRED EMBODIMENT

Figure 8:
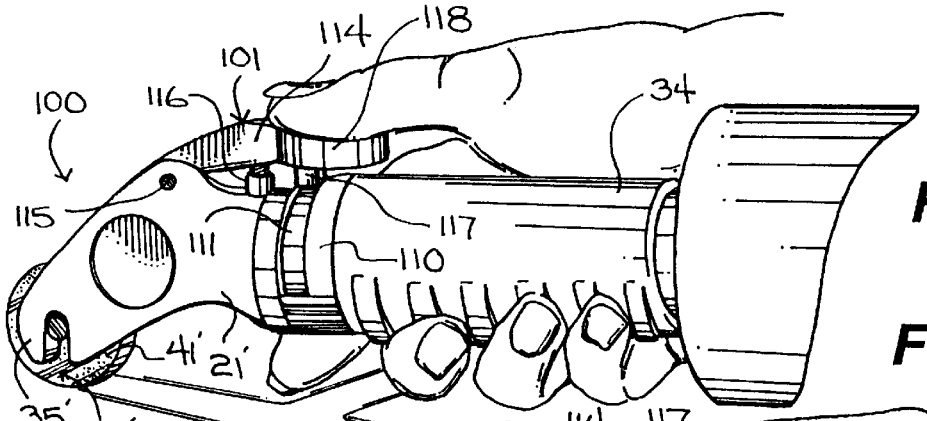
FIG. 8 is a perspective view of another embodiment of a nozzle assembly comprising a nozzle body for receiving and presenting viscous mass to an applicator for distribution to a surface and an assembly for controlling the quantity of viscous mass to the applicator, the nozzle assembly shown as it would appear in use.

The present invention provides, among other things, new and improved nozzle assemblies and applicators for surface application and distribution of viscous mass. Ensuing embodiments of the present invention prove exemplary for applying cleaning or other viscous surface treatment solutions or compositions to grout areas between tiles.

Turning now to the drawings, in which like reference characters indicate corresponding elements throughout the several views, attention is first directed to FIG. 1 which illustrates a perspective view of a nozzle assembly 20 comprising a nozzle body 21 for receiving and presenting viscous mass 22 to an applicator 23 for distribution to a surface 24 and an assembly 25 for controlling the quantity of viscous mass 22 to applicator 23, nozzle assembly 20 shown as it would appear in use. With attention directed to FIG. 7A illustrating a vertical sectional view of nozzle assembly 20, nozzle body 21 carries a passageway 30 having a proximal opening 31 for receiving viscous mass into passageway 30, a distal opening 32 for expelling viscous mass from passageway 30 and an open channel 33 (shown also in FIG. 1) for receiving viscous mass from distal opening 32 and conducting it to applicator 23 (not shown in FIG. 7A). For the purposes of orientation, proximal opening 31 is carried at an upstream end 34 of nozzle body 21 and distal opening 32 is carried adjacent a downstream end 35 of nozzle body 21. It will be generally understood that during normal use, nozzle assembly 20 conducts viscous mass from upstream end 34 to downstream end 35.

With attention directed back to FIG. 1 and with additional attention directed to FIG. 2, applicator 23 is carried by nozzle body 21 adjacent a free edge 40 of open channel 33 downstream of distal opening 32 (see FIG. 7A) and, more particularly, adjacent downstream end 35 of nozzle body 21. In this specific embodiment, applicator 23 comprises a wheel 41 supported by nozzle body 21 for rotation. Regarding FIGS. 1 and 2, downstream end 35 is bifurcated and includes slots 42 and 43 for receiving and retaining an axle 44 carried by wheel 41. Wheel 41 is preferably, but not essentially, carried by axle 44 for rotation such that with axle 44 carried in slots 42 and 43, will rotate freely relative axle 44. Axle 44 may, if so desired, be substantially rigidly carried by wheel 41 and engagable in slots 42 and 43 for rotation.

In operation, nozzle assembly 20 may be positioned to engage wheel 41 with a surface such as surface 24 comprising, as clearly shown in FIGS. 1 and 2, a grout area residing between tiles 45. With viscous mass 22 conducting through nozzle body 21 generally from upstream end 34 to downstream end 35, viscous mass 22 will present and collect onto wheel 41 from free edge 40 of open channel 33. By holding wheel 41 against surface 24 and moving nozzle assembly 20 along surface 24, such as in the direction generally indicated by the arrowed line A in FIGS. 1 and 2, wheel 41 will turn or rotate. As wheel 41 turns or rotates, viscous mass 22 will collect onto wheel 41 for wheel to carry to surface 24 as it turns for desired mechanical application and distribution. The outer diameter of wheel 41 may be provided with or otherwise carry a rubber-like coating or layer 41A (FIGS. 1 and 2) or bristles if so desired for aiding the ability of wheel 41 to collect and distribute viscous mass.

To provide nozzle assembly 20 with viscous mass, proximal opening 31 may be coupled with a viscous mass source such as, for instance, a receptacle 46 containing viscous mass shown in FIG. 12. In a specific embodiment of the present invention, passageway 30 may include a threaded counterbore 47 leading to proximal opening 31 for threaded engagement with an open threaded element or extension 48 of receptacle 46. Forcing viscous mass from receptacle 46 to nozzle assembly 20 may be accomplished by, for instance, mechanically compressing receptacle 46 for forcing viscous mass out from open threaded extension 48, providing receptacle 46 with pressured viscous mass, etc. Those of ordinary skill will readily appreciate that any appropriate mechanism for coupling receptacle 46 with nozzle 21 in viscous mass communication may be employed without departing from the teachings set forth herein.

As intimated above, assembly 25 may be employed for selectively controlling the quantity of viscous mass to applicator 23. In the particular embodiment shown in FIGS. 1, 2, 7A and 7B, assembly 25 generally comprises a sled 60 carried by nozzle body 21 for movement in reciprocal directions as generally indicated by the double arrowed line B between a first position toward downstream end 35 shown in FIGS. 2 and 7B for occluding distal opening 32 and preventing viscous mass from expelling therefrom, and a second position shown generally in FIGS. 1 and 7A for revealing distal opening 32 for permitting viscous mass to admit therefrom for receipt by open channel 33.

With specific attention to FIGS. 1, 7A and 7B, sled 60 is captured in open channel 33 for movement in reciprocal directions and includes a first end 61 directed toward downstream end 35 and a second end directed toward upstream end 34 available to be grasp for allowing a user to move sled 60 in reciprocal directions as needed during normal use. A compression spring 65 (shown also in FIG. 5) captured by nozzle body 21 and sled 60 normally biases sled 60 in the second position, although other similar biasing mechanisms may be used. An arm 63 carried by nozzle body 21 for pivotal movement may be engaged with notches 64 carried by sled 60 at or otherwise adjacent second end 62 as needed for holding sled 60 in the first position, the second position and at one or more selected positions therebetween for partially occluding distal opening 32. Headed extensions 66 (only one shown in FIGS. 1, 2, 5 and 6) carried by sled 60 admit into opposing elongate slots 67 (only one shown in FIGS. 1, 2, and 6)) carried by nozzle body 21 adjacent open channel 33 for retaining sled 60 in open channel 33 and for generally defining the path of reciprocal movement of sled 60.

Open channel 33 is an important feature of the present invention as it allows a user to visually monitor the flow of viscous mass as it passes therethrough for receipt by, for instance, applicator 23 or other desired applicator. By visually monitoring the flow of viscous mass into and through channel, a user may thus not only monitor the quantity of viscous mass received by, for instance, applicator 23, but also adjust the flow of viscous mass through nozzle body by adjusting sled selectively between the first and second positions for occluding distal opening 32, revealing distal opening 32 and partially revealing or occluding distal opening 32.

Turning now to FIGS. 3 and 4, illustrated is a perspective view of an alternate embodiment of an applicator 70 of the present invention. Applicator 70 is comprised generally of a cradle 71 including a continuous sidewall 72 having an open upper end 73 with a bifurcated extension 74 extending outwardly therefrom and a lower end 75. Applicator 70 further Includes an applicator body 80 and a foraminous body 81. Foraminous body 81 is normally carried by, and comprises a part of, cradle 71 adjacent lower end 75 and applicator body 80 is normally carried by, and extends outwardly from, foraminous body 81.

Applicator 70 may be installed with nozzle body 21 in lieu of applicator 23 and includes a pin or axle 82 carried by bifurcated extension 74 for detachable or removable engagement in slots 42 and 43 shown in FIG. 1. To enhance ease of use and for allowing desired engagement of applicator body 80 with a surface, applicator 70 is normally engagable with nozzle body 21 for pivotal movement at axle 82. In this regard, bifurcated extension 74 may be carried by axle 82 for pivotal movement, or bifurcated extension 74 may be rigidly carried by axle 82 and axle 82 engagable with slots 42 and 43 for pivotal movement.

In operation, cradle 71 operates to receive and contain viscous mass 22 from open channel 33 as shown substantially in FIG. 4. Viscous mass passes through foramina 83 carried by foraminous body 81 distributing viscous mass 22 into applicator body 80 for application and distribution to a selected surface as shown such as by, for instance, mechanically scrubbing applicator body 80 against a selected surface. Foraminous body 81 is constructed preferably of plastic or other substantially rigid material for supplying structural support to applicator body 80, and generally defines the floor of cradle 71. In the present embodiment, applicator body 80 comprises a bundle 84 of bristles embedded into foraminous body 81 or adhesively carried by foraminous body 81. However, applicator body 80 may comprise a substantially sponge-like pad or body 85 as shown in FIG. 13, a substantially abrasive scrubbing or scouring pad or body 86 as shown in FIG. 14, etc. Furthermore, to provide for substantially even distribution of viscous mass 22 to applicator body 80, foramina 83 carried by foraminous body 81 in substantially even distribution.

Figure 9:
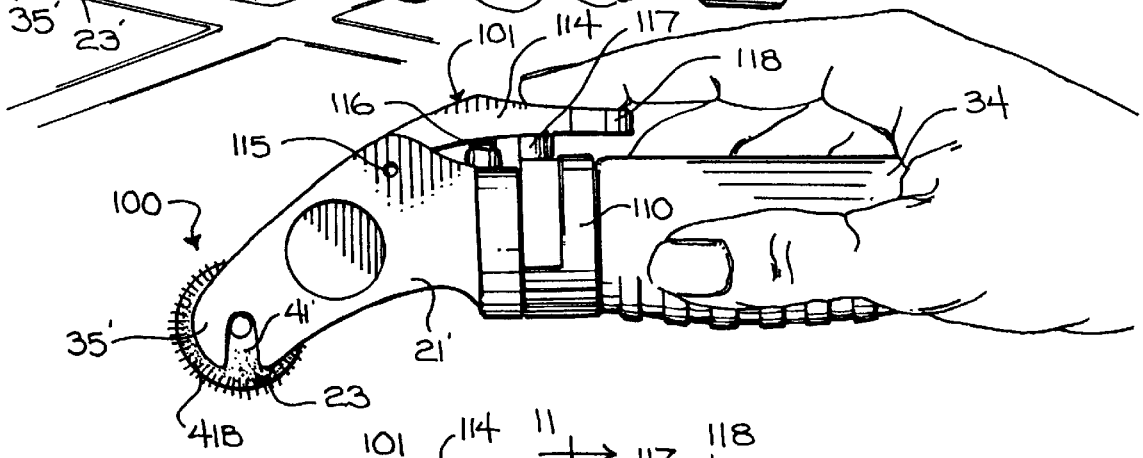
FIG. 9 is a side elevational view of the nozzle assembly of FIG. 8 shown as it would appear in use.
Figure 10:
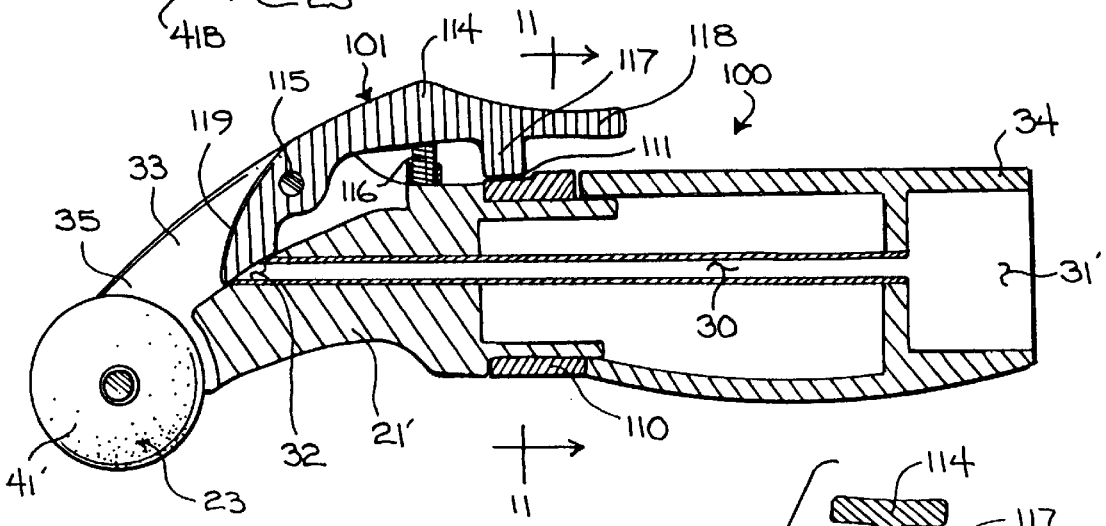
FIG. 10 is a vertical sectional view of the nozzle assembly of FIG. 8.

Turning now to FIGS. 8, 9 and 10, illustrated is a perspective view of an alternate embodiment of a nozzle assembly 100 shown as it would appear in use applying viscous mass to a surface. Nozzle assembly 100 is substantially similar to nozzle assembly 20. Therefore, reference characters used to describe nozzle assembly 20 will also be used to describe the common structural features of nozzle assembly 100. In the interests of clarity, common reference characters used to describe nozzle assembly 100 will include a prime ("') symbol.

Figure 11:
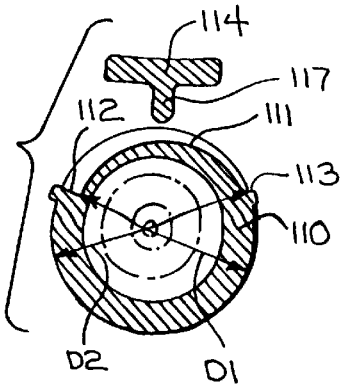
FIG. 11 is a sectional view taken along line 11—11 of FIG. 10.

Like nozzle assembly 20, nozzle assembly 100 includes nozzle body 21', applicator 23' including wheel 41' having, in this specific example, bristles 41B (shown only in FIG. 9) for aiding in the mechanical application of viscous mass, passageway 30', proximal opening 31', distal opening 32', open channel 33', upstream end 34', downstream end 35', distal opening 32' (shown only in FIG. 10) and an alternate embodiment of an assembly 101 for controlling the quantity of viscous mass to applicator 23'. In this embodiment, and with attention directed to FIG. 10, assembly 101 is generally comprised of a knob 110 carried by nozzle body 21' for rotation intermediate the upstream and downstream ends 34' and 35'. With momentary attention directed to FIG. 11 illustrating a sectional view taken along line 11—11 of FIG. 10, knob 110 includes a way 111 having a first diameter D1, a second greater diameter D2, a first stop 112 located at first diameter D1 and a second stop 113 located at second diameter D2. Way 111 defines a gradually inclining path from first diameter D1 to second greater diameter D2. Further included is a lever 114 mounted with nozzle body 21' intermediate knob 110 and downstream end 35' at pin 115 for movement in pivotal directions opposing way 111 between a first position for occluding distal opening 32' as shown in FIG. 10 and a second position for revealing distal opening 32'. Further provided is a compression spring 116 captured by lever 114 and nozzle body 21' for normally biasing an extension 117 of lever away from way 111. Those of ordinary skill will readily appreciate that other biasing mechanisms may be used for normally biasing extension 117 of lever away from way 111 without departing from the present teachings. As shown in FIG. 8, lever 114 includes an enlargement 118 extending toward upstream end 34' of nozzle body 21' that a user may depress or otherwise manipulate as needed for moving lever 114 along pivotal traverse. It will be generally understood that lever 114 includes a free end 119 (FIG. 10) directed toward downstream end 35' and positioned in substantial opposition to distal opening 32' for effecting the opening and closing of distal opening 32' upon movement of lever 114 along pivotal traverse.

To operate assembly 101, knob 110 may be grasp and rotated selectively for positioning first diameter D1 of way 111 toward extension 117, second diameter D2 of way 111 toward extension 117, and for positioning portions of way 111 intermediate first and second diameters, D1 and D2, toward extension 117. With second diameter D2 opposing extension 117 as shown substantially in FIG. 11, lever 114 is generally intended to be in the first position for occluding distal opening 32'. With first diameter D1 opposing extension 117 as shown substantially in FIG. 9, a user may engage and depress enlargement 118, such as with a finger, to move lever 114 along pivotal traverse to the second position to open distal opening 32' and engage extension 117 against diameter D1 of way. In accordance with specific needs, a user may move knob 110 to cause selected portions of way 111 intermediate first diameter D1 and second diameter D2 to face or otherwise oppose extension 117. In this regard, upon movement of lever 114 along pivotal traverse, extension 117 will engage way 111 at a selected position intermediate first diameter D1 and second diameter D2 for partially revealing or occluding distal opening 32' between the first position of lever 114 occluding distal opening 32' and the second position of lever 114 opening distal opening 32'. This allows a user to control the flow of viscous mass through distal opening 32'. Like applicator 23, applicator 23' is removable and may be replaced with applicator 70 in accordance with normal use.

In summary, the present invention provides new and improved nozzle assemblies and applicators for applying and mechanically distributing viscous mass to a surface. Applicators 23 and 70 prove exemplary for applying cleaning or other treatment solutions to grout areas between tiles, but also other desired surfaces. Foregoing embodiments are easy to construct, easy to use, and prove highly efficient for applying and distributing selected viscous mass.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A nozzle assembly for receiving and distributing a viscous mass, the nozzle assembly comprising:

a nozzle body including a passageway having a proximal opening for receiving viscous mass, a distal opening for expelling viscous mass, and a substantially U-shaped channel for receiving viscous mass from the distal opening and allowing a flow of viscous mass therethrough to be visually monitored;

an applicator mounted for receiving viscous mass from the substantially U-shaped channel and for applying viscous mass to a surface; and means located in the substantially U-shaped channel for controlling the quantity of viscous mass to the applicator.

2. The nozzle assembly of claim 1, wherein the applicator comprises a wheel mounted with the nozzle body for rotation.

3. The nozzle assembly of claim 1, wherein the wheel is removably carried by the nozzle body.

4. The nozzle assembly of claim 1, wherein the applicator comprises:

a cradle for receiving and containing viscous mass from the substantially U-shaped channel;

an applicator body; and a foraminous body for distributing viscous mass from the cradle to the applicator body.

5. The nozzle assembly of claim 4, wherein the cradle is carried by the nozzle body for movement in pivotal directions.

6. The nozzle assembly of claim 4, wherein the cradle is removably carried by the nozzle body.

7. The nozzle assembly of claim 4, wherein the applicator body is carried by the foraminous body.

8. The nozzle assembly of claim 4, wherein the foraminous body is carried by the cradle.

9. The nozzle assembly of claim 4, wherein the foraminous body is substantially rigid.

10. The nozzle assembly of claim 4, wherein the foraminous body comprises a substantially rigid floor having foramina for communicating viscous mass from the cradle to the applicator body.

11. The nozzle assembly of claim 4, wherein the applicator body comprises a bundle of bristles.

12. The nozzle assembly of claim 4, wherein the applicator body comprises one of a substantially sponge-like pad and a substantially abrasive scouring pad.

13. The nozzle assembly of claim of claim 4, wherein the foramina are substantially evenly distributed for substantially evenly distributing viscous mass to the applicator body.

14. Apparatus comprising:

a receptacle containing viscous mass; and a nozzle assembly engaged to the receptacle for receiving viscous and distributing viscous mass, the nozzle assembly comprising:

a nozzle body including a passageway having a proximal opening for receiving viscous mass, a distal opening for expelling viscous mass, and a substantially U-shaped channel for receiving viscous mass from the distal opening and allowing a flow of viscous mass therethrough to be visually monitored;

an applicator mounted for receiving viscous mass from the substantially U-shaped channel and for applying viscous mass to a surface; and means located in the substantially U-shaped channel for controlling the quantity of viscous mass to the applicator.

15. Apparatus of claim 14, wherein the means for controlling the quantity of viscous mass to the applicator comprises a sled carried by the nozzle body for movement in reciprocal directions between a first position for occluding the distal opening and a second position for revealing the distal opening.

16. Apparatus of claim 14, wherein the means for controlling the quantity of viscous mass to the applicator comprises:

a knob carried by the nozzle body for rotation, the knob including a way having a first diameter and a second diameter; and a lever mounted with the nozzle body for movement in pivotal directions between a first position against the way for occluding the distal opening and a second position against the way for revealing the distal opening, the first position corresponding with one of the first and second diameters and the second position corresponding to the other one of the first and second diameters.

17. Apparatus of claim 14, wherein the applicator comprises a wheel mounted with the nozzle body for rotation.

18. Apparatus of claim 17, wherein the wheel is removably carried by the nozzle body and carries one of bristles and a rubber-like layer for aiding in the mechanical application of viscous mass.

19. Apparatus of claim 14, wherein the applicator comprises:

a cradle for receiving and containing viscous mass from the substantially U-shaped channel;

an applicator body; and a foraminous body for distributing viscous mass from the cradle to the applicator body.

20. Apparatus of claim 19, wherein the cradle is carried by the nozzle body for movement in pivotal directions.

21. Apparatus of claim 19, wherein the cradle is removably carried by the nozzle body.

22. Apparatus of claim 19, wherein the applicator body is carried by the foraminous body.

23. Apparatus of claim 19, wherein the foraminous body is carried by the cradle.

24. Apparatus of claim 19, wherein the foraminous body is substantially rigid.

25. Apparatus of claim 19, wherein the foraminous body comprises a substantially rigid floor having foramina for communicating viscous mass from the cradle to the applicator body.

26. Apparatus of claim 19, wherein the applicator body comprises a bundle of bristles.

27. Apparatus of claim 19, wherein the applicator body comprises a substantially sponge-like pad.

28. Apparatus of claim of claim 24, wherein the foramina are substantially evenly distributed for substantially evenly distributing viscous mass to the applicator body.

* * * * *